United States Patent [19]

Fleetwood et al.

[11] 4,198,788

[45] Apr. 22, 1980

[54] METHOD OF FORMING A SHARP EDGE ON AN OPTICAL DEVICE

[75] Inventors: Charles M. Fleetwood, Odenton; Stephen H. Rice, Waldorf, both of Md.

[73] Assignee: The United States of America as represented by the Administrator of the National Aeronautics and Space Administration, Washington, D.C.

[21] Appl. No.: 929,088

[22] Filed: Jul. 28, 1978

[51] Int. Cl.[2] ..... B24B 1/00

[52] U.S. Cl. ..... 51/283 R; 51/277; 65/61

[58] Field of Search ..... 51/277, 283 R, 284 R, 51/323, 237 R; 65/61, 112

[56] References Cited

U.S. PATENT DOCUMENTS

| | | | |
|---|---|---|---|
| 2,393,073 | 1/1946 | Tenny | 51/283 R |
| 2,420,606 | 5/1947 | McLeod | 51/283 R X |
| 2,441,590 | 5/1948 | Ohl | 51/283 R X |
| 2,699,633 | 1/1955 | Lapenas | 51/283 R X |
| 2,807,922 | 10/1957 | Newcomer | 51/284 R |
| 3,236,010 | 2/1966 | Evans | 51/283 R |
| 3,254,556 | 6/1966 | Stauton | 51/283 R X |
| 3,583,110 | 6/1971 | Scott | 51/283 R |
| 3,981,709 | 9/1976 | Kondo | 51/284 R X |

OTHER PUBLICATIONS

"New Developments in Optical Fabrication Techniques", R. R. Rigby, Optical Engineering, vol. 14, No. 2, pp. 145–148.

*Primary Examiner*—Gary L. Smith

*Attorney, Agent, or Firm*—Robert D. Marchant; John R. Manning; John O. Tresansky

[57] ABSTRACT

A method of forming a sharp edge on an optical device. The method involves the steps of placing the optical device in a holding mechanism; grinding one surface of the optical device so the one surface and a surface of the holding mechanism are co-planer; and polishing the one surface of the optical device and the surface of the holding mechanism with felt until an edge on the one surface of the optical device adjacent the surface of the holding mechanism obtains a desired sharpness.

15 Claims, 12 Drawing Figures

METHOD OF FORMING A SHARP EDGE ON AN OPTICAL DEVICE

ORIGIN OF THE INVENTION

The invention described herein was made by employees of the United States Government and may be manufactured and used by or for the Government for governmental purposes without the payment of any royalties thereon or therefore.

BRIEF SUMMARY OF THE INVENTION

This invention relates generally to optical device formation and more particularly to a method of forming a sharp edge on optical devices.

The field of optical technology has grown extremely rapidly since the advent of space research. Optical experiments are placed aboard spacecraft to learn more about optical energy received from various sources within the universe. As more is learned more advanced technical apparatuses are needed to detect and measure optical phenomenon. One such phenomenon under investigation is the effect that magnetic fields have on beams of light energy received from light emitting bodies such as the sun. This, of course, is the classical Zeeman Effect and various experiments have been developed to measure the Zeeman Effect.

One of the criteria for measuring the magnetic effects on light beams is to split a beam of light into two separate beams which are detected and the magnetic effect measured on each. The beam of light is required to be physically split rather than split by a conventional beam splitter. The beam of light is impinged on an edge of an optical wedge on which the angled side is optically polished for reflection of the light beam. The optical wedge is placed in the path of the light beam so that the edge splits the light beam causing one half to pass uninterrupted along one side of the optical wedge to an optical detector. The other half of the light beam strikes the angled optically polished side of the optical wedge and is reflected to another optical detector. The critical factor to be considered is ensuring that the maximum amount of each split portion of the light beam is detected by their respective detectors. Consequently, the edge of the optical wedge cutting the light beam must be as sharp as possible.

Conventionally, edges have been formed on optical apparatuses, such as glass, silicon crystals, quartz, and others by cutting strips of optical material from an ingot. A groove is cut at an angle into a chuck or holding device. The optical material is placed in the groove and held thereto by cement, wax, or by any other conventional method. The chuck is connected to a motor for rotating and oscillating the optical material simultaneously. A container holds a suitable grinding material such as a metal lap with grooves and is filled with a grinding bath. The chuck is lowered into the bath and rotated and oscillated while in contact with the grinding material. In some instances the container is also rotated in the same direction as the chuck but at a different speed. After the optical material is ground flat, the chuck polishing material is substituted for the grinding material and the process is repeated until the desired edge sharpness is obtained.

Conventionally, the polishing material used to form a sharp edge is pitch and the polishing bath is a mixture of water and cerium oxide or the like.

One disadvantage with this prior art method is that a sharpness of only about 2 micron can be obtained. A 2 micron sharpness is entirely inadequate for physically splitting a beam of light. Firstly, at a sharpness of 2 micron a large part of the light beam strikes the edge and is reflected in all directions which prevents the detectors from receiving this portion of the light beam. Secondly, most light beams which are to be split and detected are themselves only a few micron thick and such an edge sharpness would randomly reflect most of the light beam away from the detectors. Another disadvantage is that when an edge sharpness of less than 2 micron is attempted to be obtained on a relatively small wedge angle the edge tends to break, become uneven or the optical material peels from the edge. This renders the edge useless as a physical optical beam splitter. Another disadvantage of this method is that when using conventional polishing material such as pitch, the polishing time is very consuming. To obtain an edge sharpness of 2 micron it is not unusual to polish a surface for about 48 hours.

Briefly, these and other disadvantages are overcome by providing a method of forming a sharp edge on an optical device having the steps of placing the optical device in a holding mechanism; griding one surface of the optical device so that the one surface and a surface of the holding apparatus are co-planer; and polishing the one surface of the optical device and the surface of the holding apparatus with felt until an edge on the device adjacent to the surface of the holding apparatus has a desired sharpness.

Accordingly, one object of the invention is to provide a new and improved method of forming an edge on an optical device.

Another object of this invention is to provide a method of forming an edge having a sharpness less than 2 micron on an optical device.

Still another object of the present invention is to provide a method of forming an edge on an optical device that has a sharpness of about 0.3 micron.

A further object of the present invention is to provide a method of forming an edge having a sharpness of less than 2 micron on an optical device without breaking the edge, peeling the optical material away from the edge, or forming an uneven edge.

A still further object of the present invention is to provide a method of forming an edge on an optical device that has a sharpness of less than 2 micron in a relatively short time period.

The above and further objects of the invention will appear more fully from the following detailed description when read in conjunction with the accompanying drawings.

BRIEF DESCRIPTION OF THE DRAWINGS

In the drawings where like parts are designated by the same references.

DESCRIPTION OF THE PREFERRED EMBODIMENT

Figure 1:
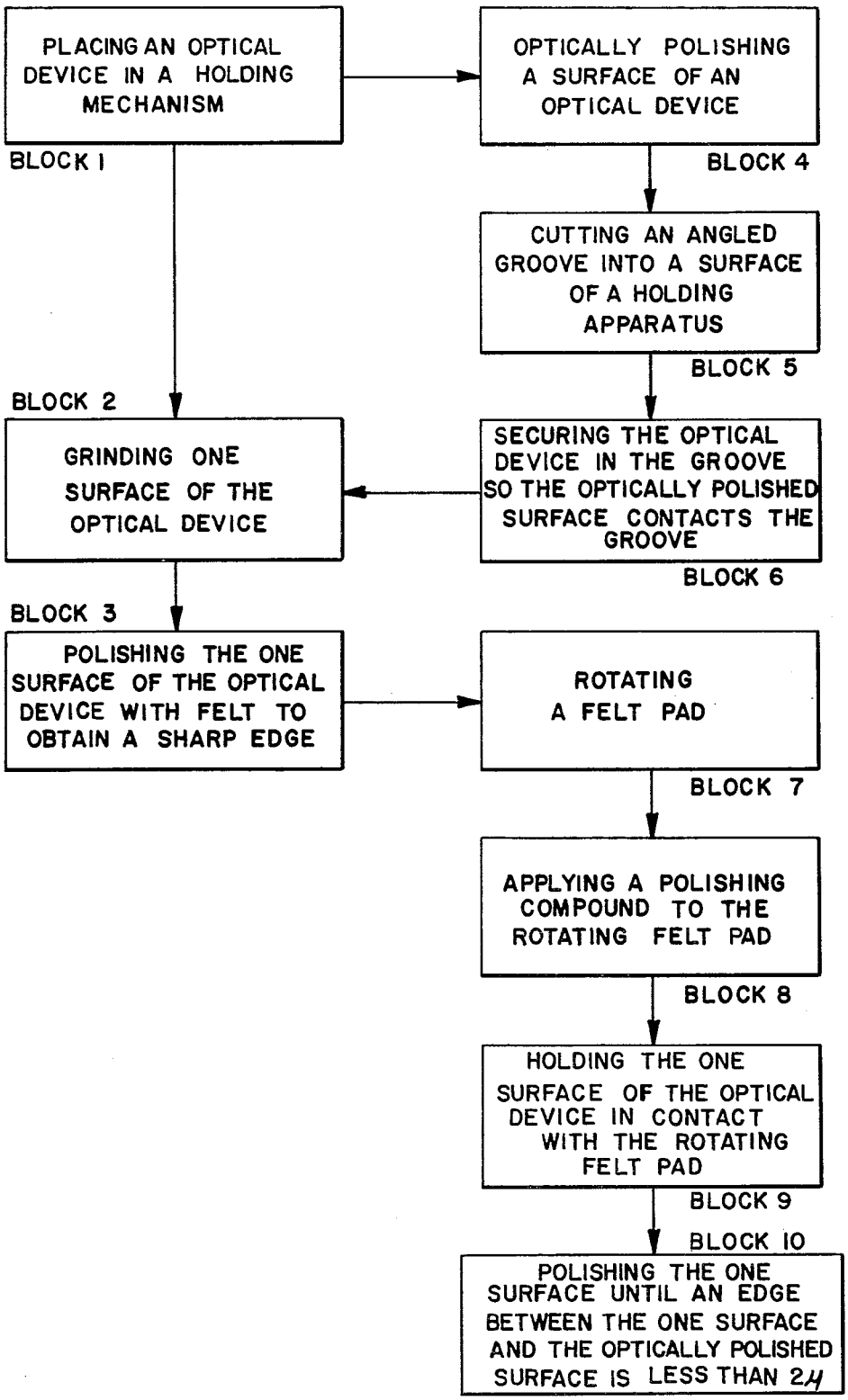
FIG. 1 is a block flow diagram showing the process steps of forming a sharp edge on an optical device.

Referring to FIG. 1, the method of forming a sharp edge on an optical device is shown generally in blocks 1–3. Block 1 illustrates the first step of placing the optical device in a holding mechanism. Block 2 illustrates the next step of grinding one surface of the optical device so that the ground surface and the surface of the holding mechanism are co-planer. Block 3 illustrates the third step of polishing the one surface of the optical device and the surface of the holding mechanism with felt until an edge of the surface of the optical device adjacent to the surface of the holding mechanism has a desired sharpness.

Blocks 4–6 represent, more specifically the steps performed in Block 1 and Blocks 7–10 represent in greater detail the steps performed in Block 3. The step of placing an optical device in a holding mechanism in Block 1, includes the step of optically polishing a surface of the optical device as illustrated in Block 4. Block 5 illustrates the next step of cutting an angled groove into a surface of a holding mechanism. Block 6 illustrates the next step of securing the optical device in the groove with the optically polished surface contacting the groove. The step of polishing the one surface of the optical device with felt to obtain a sharp edge, as illustrated in Block 3, includes the step of rotating a felt pad as illustrated in Block 7. Block 8 illustrates the next step of applying a polishing compound to the rotating felt pad. Block 9 illustrates the next step of holding the surface of the holding mechanism and the one surface of the optical device in contact with the rotating felt pad. Block 10 illustrates the last step of polishing the one surface of the optical device until the edge formed at the intersection between the optically polished surface and the one surface has a sharpness of less than 2 micron.

Figure 2:
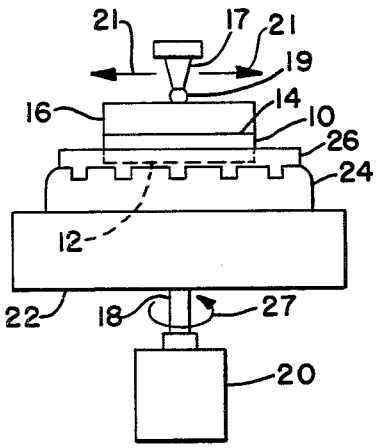
FIG. 2 is a side view of the apparatus for optically polishing one side of the optical device.
Figure 3A:
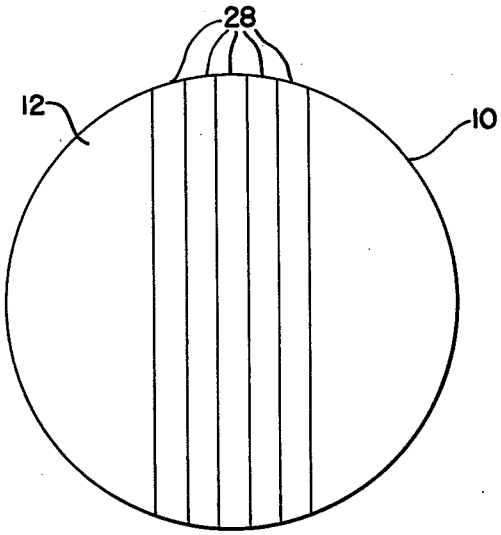
FIGS. 3A and 3B are top and side views, respectively, of optical devices having been cut from the optically polished blank.
Figure 3B:
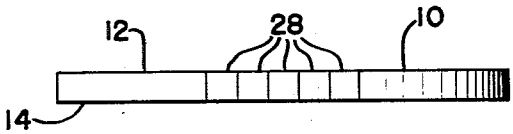

FIGS. 2, 3A, and 3B show that the step of placing an optical device in a holding mechanism is performed by obtaining a large blank 10 of optical material such as glass, quartz, or the like. The type of material used for blank 10 will depend upon the end purpose of the optical device. If the device is to be used as a beam splitter glass is the preferred material. When making a beam splitter the side thereof that will reflect one half of the energy beam is preferrably optically polished so that the entire portion reflected will be reflected to an appropriate detector (not shown). Blank 10 has a pair of opposed surfaces 12 and 14 of which surface 12 is to be optically polished using any conventional polishing procedure such as pitch polishing. When pitch polishing surface 12, surface 14 is attached in any conventional manner to a holding plate 16. A pivot arm 17 is in contact with holding plate 16 and allows rotational movement of plate 16 and blank 10 about a pivot ball 19 of pivot arm 17. Pivot arm 17 also oscillates plate 16 and blank 10 back and forth as indicated by arrows 21. In axial alignment with blank 10 is a support 22 having a polishing material 24 thereon which may be any conventional material although pitch is preferred. A polishing compound 26 is applied on top of the pitch. Preferably, the polishing compound is cerium oxide, mixed with water to form a slurry although other compounds such as ferric oxide may also be used. Support 22 is connected to shaft 18 or motor 20. When energized, motor 20 will rotate support 22, pitch 24, and compound 26 in the direction of arrow 27. Motor 20 is energized and blank 10 is lowered by pivot arm 17 until surface 12 contacts pitch 24. Blank 10 is held in contact with pitch 24 for a time sufficient to optically polish surface 12 to a flatness of substantially $\lambda/10$, where $\lambda$ is the wavelength of the energy beam to be reflected by surface 12.

Upon completeion of optically polishing surface 12, blank 10 is removed from holding plate 16. Blank 10 is cut as by a diamond cutter (not shown) into strips of optical devices 28 upon which the sharp edge is to be formed.

Figure 4:
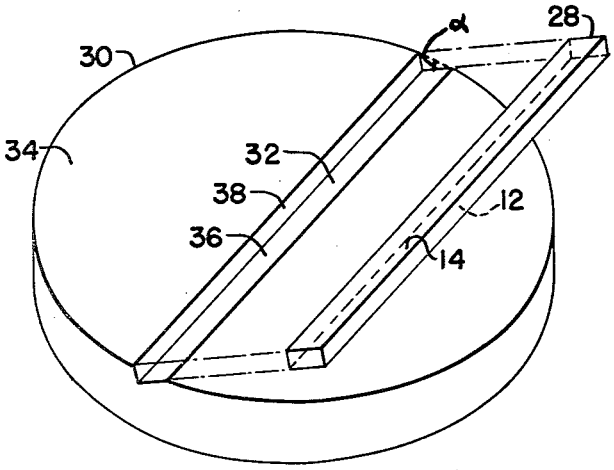
FIG. 4 is a perspective view of the holding mechanism for the optical device showing the groove cut at an angle into the holding mechanism and an exploded view of the optical device that fits within the groove.
Figure 5:
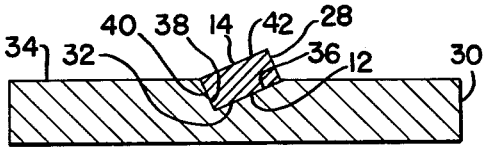
FIG. 5 is a side view in cross-section of the holding mechanism showing the optical device in the angled groove.
Figure 6:
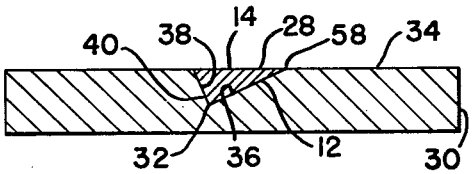
FIG. 6 is a side view in cross-section showing the holding mechanism and optical device following the step of grinding.

FIGS. 4, 5, and 6 illustrate the preferred method of securing an optical device 28 in a holding mechanism 30 so that a sharp edge can be formed on optical device 28. Holding mechanism 30 is preferably cylindrical in shape having a diameter substantially the same as the length of optical device 28. Holding mechanism 30 may be made from any type material although preferably from the same type material as optical device 28.

To hold optical device 28 a groove 32 is cut into surface 34 of the holding mechanism 30 such as by using a diamond saw. To properly form a sharp edge on optical device 28 it is preferred that optical device 28 be wedged shaped so that the edge formed by the wedge angle can be as sharp as possible. The larger the wedge angle the easier it is to form a sharp edge. Conversely, if a wedge angle is made small it becomes very difficult to form a sharp edge without breakage because the wedge shaped optical device would be very thin. Accordingly, groove 32 is cut so that a surface 36 of groove 32 is formed at an angle $\alpha$ to surface 34. Surface 38 of groove 32 is then cut into surface 34 to complete groove 32. The length of surface 38 is preferably the same or less than the length of surface 40 of optical device 28 so that a portion 42 will extend above surface 34. Preferably, angle $\alpha$ is an acute angle and more preferably is less than 45 degrees. It has been found that an angle of substantially 26 degrees can be produced with the desired edge sharpness without any edge breakage.

After groove 32 is cut, surfaces 36 and 38 are waxed with conventional optical wax and optical device 28 is placed in groove 32 and held secure by the wax. Surface 40 abuts surface 38 and optically polished surface 12 abuts surface 36 causing portion 42 to extend above surface 34. With surface 12 abutting surface 36 a sharp edge can be formed without damaging the optically polished surface.

Figure 7:
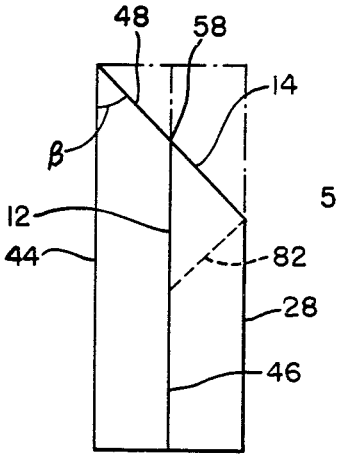
FIG. 7 is a side view of an alternative holding mechanism for the optical device showing the optical device being held by optical contact.

An alternative holding mechanism 44 is shown in FIG. 7. This mechanism includes a surface 46 which has been optically polished in the same manner as surface 12 of optical device 28. Surface 12 of optical device 28 is placed in contact with surface 46 of holding mechanism 44 and because both surfaces are polished flat no air gaps remain between the surfaces. This causes the surfaces 12 and 46 to be held tightly together. The holding mechanism 44 and optical device 28 are cut at an angle $\beta$ to form surface 14 on optical device 28 and a surface 48 on holding mechanism 44.

Figure 8:
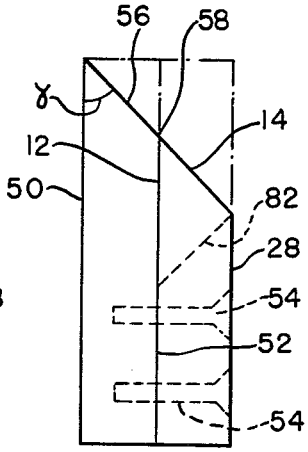
FIG. 8 is a side view of another alternative holding mechanism for the optical device showing the optical device held by mechanical contacting.

Another alternative holding mechanism 50 is illustrated in FIG. 8. This has a surface 52 that does not need to be optically polished to any desired flatness. Optical device 28 is secured to holding mechanism 50 with screws 54 so that surface 12 abuts surface 52. Holding mechanism 50 and optical device 28 are cut at an angle $\gamma$ to form surface 14 on optical device 28 and a surface 56 on holding mechanism 50.

Referring again to FIGS. 4, 5, and 6, holding mechanism 30 and portion 42 of optical device 28 are ground in the conventional manner until surfaces 14 and 34 are substantially co-planer. Preferably, portion 42 is ground using a device similar to that shown in FIG. 2 for optically polishing surface 12. For grinding, however, pitch 24 and polishing compound 26 is removed and replaced with the desired grinding surface (not shown) and grinding compound (not shown). Holder 30 with optical device 28 is secured to holding plate 16 in a conventional manner. Motor 20 is activated causing support 22 and the grinding surface and compound to rotate. Holder 30 is lowered until portion 42 contacts the grinding surface and then activated to oscillate holder 30 and optical device 28. Portion 42 is ground down until surface 14 is co-planer with surface 34, as shown in FIG. 6. Following the process of grinding, holder 30 with optical device 28 is removed from holding plate 16.

By the process of grinding portion 42 until surface 14 is substantially co-planer with surface 34, an edge 58 is formed between surfaces 12 and 14 and the angle formed at edge 58 between surfaces 12 and 14 is angle $\alpha$. Edge 58 is the edge to be polished to the desired sharpness. When using holders 44 and 50 as shown in FIGS. 7 and 8 respectively, surfaces 48 and 14 and surfaces 56 and 14 are ground in the manner previously described to form edge 58 between surfaces 12 and 14 of optical device 28.

Figure 9:
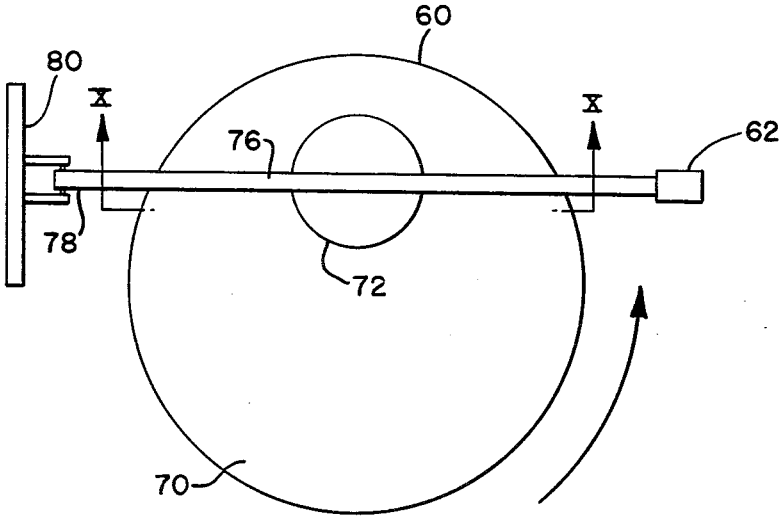
FIG. 9 is a top view of the apparatus for polishing the surface of the holding mechanism and optical device to form a sharp edge.
Figure 10:
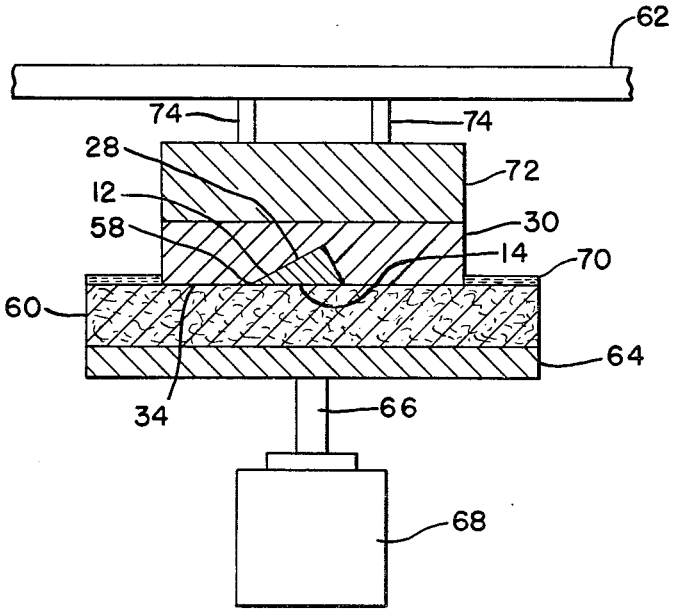
FIG. 10 is a side view in cross-section of the apparatus of FIG. 9 taken along the lines of X—X showing the felt pad in contact with the optical device and holding mechanism.

Referring to FIGS. 9 and 10, following the step of grinding, surface 14 of optical device 28 and surface 34 of holding mechanism 30 are polished with felt 60 for a time sufficient to sharpen edge 58 to the desired sharpness. An apparatus 62 is provided for performing the polishing. Apparatus 62 includes a support plate 64 which is connected to shaft 66 of motor 68. Felt pad 60 is secured to support plate 64 as by cementing or other adhesive. A polishing compound 70 consisting of a slurry formed of water and a polishing material of cerium oxide or ferric oxide is placed in contact with felt pad 60.

Holding mechanism 30 is secured in any conventional manner to a holding plate 72 so that surface 34 of holding mechanism 30 and surface 14 of optical device 28 are adjacent to polishing compound 70 and felt pad 60. Holding plate 72 is connected, as by rods 74, to a handle 76. Handle 76 is pivotably connected at end 78 to a support 80. As illustrated in FIG. 9, handle 76, holding plate 72, holding mechanism 30 and optical device 28 are off-set from the center of felt pad 60. The position of the off-set is determined by the direction of rotation of felt pad 60 and the position of edge 58.

To prevent edge 58 from breaking during polishing to a very sharp edge, holding mechanism 30 and optical device 28 are held stationary during polishing, that is, optical device 28 is not oscillated or allowed to rotate. The only item being rotated during the polishing step is felt pad 60 and polishing compound 70. In addition, to prevent any peeling effect on optical device 28 edge 58 is the trailing edge to the rotation. Consequently, when edge 58 is positioned as illustrated in FIG. 10, holding mechanism 30 and optical device 28 are off-set as illustrated in FIG. 9 and felt pad 60 is rotated in the direction indicated by the arrow.

Although one position of optical device 28 has been described, it should be understood that optical device 28 may be off-set at any location from the center of felt pad 60. The pad may be rotated in either direction, the only criteria being that edge 58 remain a trailing edge to the direction of rotation.

To produce a sharp edge on edge 58, motor 68 is activated to rotate felt pad 60 and polishing compound 70 in the direction indicated. Handle 76 with holding mechanism 30 and optical device 28 attached thereto is off-set from the center of felt pad 60 so that edge 28 is the trailing edge to the rotation. Optical device 28 is pivoted downward until surface 34 of holding device 30 and surface 14 of optical device 28 are in contact with rotating felt pad 60 and pressure is applied to handle 72. The rotating felt pad 60 and polishing compound 70 polish surfaces 34 and 14. The required time for polishing is variable and dependent on the amount of sharpness desired on edge 58. In the conventional polishing techniques, edge 58 can only be sharpened to a sharpness of about 2 micron which may take upwards of 48 hours to produce. With the disclosed felt polishing technique edge 58 can be sharpened to less than 2 micron down to about 0.3 micron which is necessary for proper beam splitting. It has been found that the time for polishing edge 58 to 0.3 micron using the felt polishing technique is only a few hours depending on the pressure applied to handle 76, the speed of rotation of felt pad 60, and the quality of the ground surface.

When using the holding mechanism 44 and 50 of FIGS. 7 and 8, respectively, the polishing step is performed in the same manner as previously described for holding mechanism 30 and therefore will not be further described.

Figure 11:
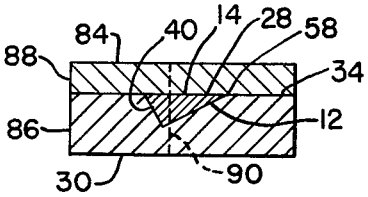
FIG. 11 is a side view in cross-section of the holding mechanism and optical device of FIG. 10 after the step of felt polishing showing the portion of the optical device removed by grinding to form an optical beam splitter.

Referring to FIG. 11, if optical device 28 is to be used as a beam splitter, upon completion of the polishing step a support device 84 is attached to surface 34 and 14 of holding mechanism 30 and optical device 28, respectively, in any conventional manner such as by using wax. Holding mechanism 30 and support device 84 are cut down such as by a diamond cutter substantially parallel to the longitudinal axis of optical device 28 to form surfaces 86 and 88 respectively. Surfaces 86 and 88 are ground in the conventional manner as previously set forth and surface 40 of optical device 28 is also ground away until a point at substantially hatched line 90 is reached. Thus, surface 12 which is the optically polished surface becomes the hypotenuse of a triangle so that one half of the optical beam will be reflected off surface 12. Upon completion of the grinding, holding mechanism 30, support 84, and device 28 are cut into desired lengths, and then device 28 is removed from holding mechanism 30 for use as a beam splitter. When using holding mechanisms 44 and 50 of FIGS. 7 and 8, optical device 28 is cut along hatched lines 82 to produce a wedge-shaped optical device so that optically polished surface 12 is the angled side to properly reflect half the energy Beam.

Although the product of the method has been described as an energy beam splitter, it should be understood that the method may be used to produce a variety of products requiring extremely sharp edges on the order of 2 micron or less. For example, the method may be used to produce sharp edges on the entrance and exit slits of a spectrometer to enhance the diffraction pattern of the subject energy beam. In addition, the method may be used to produce very sharp throw away surgical instruments.

A method of forming a sharp edge on an optical device has been disclosed. Obvious modifications and variations of the method are possible in light of the above teachings. For example, the pivotal handle for applying pressure to the optical device may be replaced with an automatic spring device or hydralically operated plunger system. It is to be understood, therefore, that within the scope of the appended claims the method may be practiced otherwise than as specifically described and illustrated.

Accordingly, the invention having been described in its best embodiment and mode of operation, that which is desired to be claimed by Letters Patent is:

1. A method of forming a sharp edge on an optical device comprising the steps of:

placing said optical device in a holding device;

grinding one surface of said optical device until one surface thereof and a surface of said holding device are co-planer; and polishing said one surface of said optical device and said surface of said holding device with felt until an edge of said one surface of said optical device adjacent to said surface of said holding device has a desired sharpness, said step of polishing including the steps of;

rotating said felt, holding said optical device and said holding device from rotating, aligning said edge so that said edge is a trailing edge to said rotation of said felt, holding said one surface of said optical device and said holding device in contact with and off-set from the center of said rotating felt, and applying pressure to said optical device and said holding device.

2. The method of claim 1 wherein said step of placing includes:

cutting a groove in said holding device; and securing said optical device within said groove so that a portion of said optical device extends above said surface of said holding device.

3. The method of claim 2 wherein said step of cutting includes cutting said groove at an angle to said surface of said holding device.

4. The method of claim 3 wherein said angle is an acute angle.

5. The method of claim 3 wherein said angle is less than 45 degrees.

6. The method of claim 2 wherein the step of securing includes:

optically polishing another surface of said optical device opposed from said one surface; and placing said another surface in contact with said groove.

7. The method of claim 1 wherein said step of placing includes:

optically contacting a surface adjacent to said one surface of said optical device to a surface adjacent to said surface of said holding device; and cutting said holding device and said optical device at an angle to said optically contacting surfaces, said cutting forming said one surface of said optical device and said surface of said holding device to be felt polished.

8. The method of claim 1 wherein said step of placing includes:

mechanically contacting a surface adjacent to said one surface of said optical device to a surface adjacent to said surface of said holding device; and cutting said holding device and said optical device at an angle to said mechanically contacting surfaces, said cutting forming said one surface of said optical device and said surface of said holding device to be felt polished.

9. The method of claim 1 wherein said step of polishing further includes applying a polishing material to said felt.

10. The method of claim 9 wherein said polishing material is a slurry mixture of water and a polishing compound selected from the group consisting of cerium oxide and ferric oxide.

11. The method of claim 10 wherein said step of polishing continues untl said trailing edge obtains a sharpness of less than 2 micron.

12. The method of claim 10 wherein said step of polishing continues until said trailing edge obtains a sharpness of substantially 0.3 micron.

13. A method of forming an optical device for splitting a beam of energy on an edge of said device comprising the steps of:

optically polishing a surface on said optical device;

cutting a groove into a surface of a holding device, said groove being angled with respect to said surface of said holding device;

securing said optical device in said groove with said optically polished surface of said optical device contacting said groove;

grinding another surface of said optical device opposed from said optically polished surface and said surface of said holding device until said surfaces are substantially co-planer;

rotating a felt pad;

applying a polishing material to said rotating felt pad;

holding said surface of said holding device and said another surface of said optical device in contact with said rotating felt pad;

applying pressure to said holding device and optical device while said another surface of said optical device and said surface of said holding device contact said felt pad;

holding said optical device and said holding device against said felt pad so that as said felt pad rotates said edge is a trailing edge; and polishing said another surface of said optical device until said edge formed at the intersection between said surfaces and said another surface of said optical device obtains a sharpness of less than 2 micron.

14. The method of claim 13 wherein said polishing material is a slurry mixture of water and a polishing compound selected from a group consisting of cerium oxide and ferric oxide.

15. The method of claim 13 wherein said step of polishing includes the step of polishing said another surface of said optical device until said edge obtains a sharpness of substantially 0.3 micron.

* * * * *